US005696879A

United States Patent [19]

Cline et al.

[11] Patent Number: 5,696,879

[45] Date of Patent: Dec. 9, 1997

[54] METHOD AND APPARATUS FOR IMPROVED VOICE TRANSMISSION

[75] Inventors: Troy Lee Cline, Cedar Park; Scott Harlan Isensee, Georgetown; Frederic Ira Parke; Ricky Lee Poston, both of Austin; Gregory Scott Rogers; Jon Harald Werner, both of Austin, all of Tex.

[73] Assignee: International Business Machines Corporation, Armonk, N.Y.

[21] Appl. No.: 455,430

[22] Filed: May 31, 1995

[51] Int. Cl.[6] ..... G10L 5/02

[52] U.S. Cl. ..... 395/2.69; 395/2.44; 395/2.79; 395/2.81; 395/2.87

[58] Field of Search ..... 395/2.44, 2.69, 395/2.79, 2.81, 2.87

[56] References Cited

U.S. PATENT DOCUMENTS

| | | | |
|---|---|---|---|
| 4,124,773 | 11/1978 | Elkins . | |
| 4,588,986 | 5/1986 | Byrne . | |
| 4,626,827 | 12/1986 | Kitamura et al. . | |
| 4,707,858 | 11/1987 | Fette | 395/2.6 |
| 4,903,021 | 2/1990 | Leibholz . | |
| 4,942,607 | 7/1990 | Schroder et al. . | |
| 4,975,957 | 12/1990 | Ichikawa et al. | 395/2.29 |
| 5,168,548 | 12/1992 | Kaufman et al. . | |
| 5,179,576 | 1/1993 | Hopkins et al. . | |
| 5,199,080 | 3/1993 | Kimura et al. . | |
| 5,226,090 | 7/1993 | Kimura . | |
| 5,297,231 | 3/1994 | Miller . | |
| 5,386,493 | 1/1995 | Degen et al. | 395/2.76 |

OTHER PUBLICATIONS

F. I. Parke, "Visualized Speech Project", IBM Paper, May 28, 1992, 19 pages.

*Primary Examiner*—Allen R. MacDonald
*Assistant Examiner*—Alphonso A. Collins
*Attorney, Agent, or Firm*—Diana L. Roberts; Richard A. Henkler; Andrew J. Dillon

[57] ABSTRACT

A uniquely programmed computer system and computer-implemented method direct a computer system to efficiently transmit voice. The method includes the steps of transforming voice from a user into text at a first system, converting a voice sample of the user into a set of voice characteristics stored in a voice database in a second system, and transmitting the text to the second system, whereby the second system converts the text into audio by synthesizing the voice of the user using the voice characteristics from the voice sample. The voice characteristics and text may be transmitted individually or jointly. However, if the system transmits voice characteristics individually, subsequent multiple text files are transmitted and converted at the second system using the stored voice characteristics located within the second system.

8 Claims, 2 Drawing Sheets

METHOD AND APPARATUS FOR IMPROVED VOICE TRANSMISSION

BACKGROUND OF THE INVENTION

1. Field of the Invention

The present invention relates to improvements in audio/voice transmission and, more particularly, but without limitation, to improvements in voice transmission via reduction in communication channel bandwidth.

2. Background Information and Description of the Related Art

The spoken word plays a major role in human communications and in human-to-machine and machine-to-human communications. For example, voice mail systems, help systems, and video conferencing systems have incorporated human speech. Speech processing activities lie in three main areas: speech coding, speech synthesis, and speech recognition. Speech synthesizers convert text into speech, while speech recognition systems "listen to" and understand human speech. Speech coding techniques compress digitized speech to decrease transmission bandwidth and storage requirements.

A conventional speech coding system, such as a voice mail system, captures, digitizes, compresses, and transmits speech to another remote voice mail system. The speech coding system includes speech compression schemes which, in turn, include waveform coders or analysis-resynthesis techniques. A waveform coder samples the speech waveform at a given rate, for example, 8 KHz using pulse code modulation (PCM). A sampling rate of about 64 Kbit/s is needed for acceptable voice quality PCM audio transmission and storage. Therefore, recording approximately 125 seconds of speech requires approximately 1M byte of memory, which is a substantial amount of storage for such a small amount of speech. For combined voice and data transmission over common telephone transmission lines, the available bandwidth, 28.8 Kb/s using current technology, must be partitioned between voice and data. In such situations, transmission of voice as digital audio signals is impracticable because it requires more bandwidth than is available.

Therefore, there is great demand for a system that provides high quality audio transmission, while reducing the required communication channel bandwidth and storage.

SUMMARY

An apparatus and computer-implemented method transmit audio (e.g., speech) from a first data processing system to a second data processing system using minimum bandwidth. The method includes the step of transforming audio (e.g. a speech sample) into text. The next step includes converting a voice sample of the speaker into a set of voice characteristics, whereby the voice characteristics are stored in a voice database in a second system. Alternatively, voice characteristics can be determined by the originating system (i.e., first system) and sent to the receiving system (i.e., second system). The final step includes transmitting the text to the second system, whereby the second system converts the text into audio by synthesizing the voice of the speaker using the voice characteristics from the voice sample.

Therefore, it is an object of the present invention to provide an improved voice transmission system that lessens the transmission bandwidth.

It is a further object to provide an improved voice transmission system that converts audio into text before transmission, thereby reducing the transmission bandwidth and storage requirements significantly.

It is yet another object to provide an improved voice transmission system that transmits a voice sample of the speaker such that the synthesized speech playback of the text resembles the voice of the speaker.

These and other objects, advantages, and features will become even more apparent in light of the following drawings and detailed description.

DETAILED DESCRIPTION OF THE PREFERRED EMBODIMENT

The preferred embodiment includes a computer-implemented method and apparatus for transmitting text, wherein a smart speech synthesizer plays back the text as speech representative of the speaker's voice.

Figure 1:
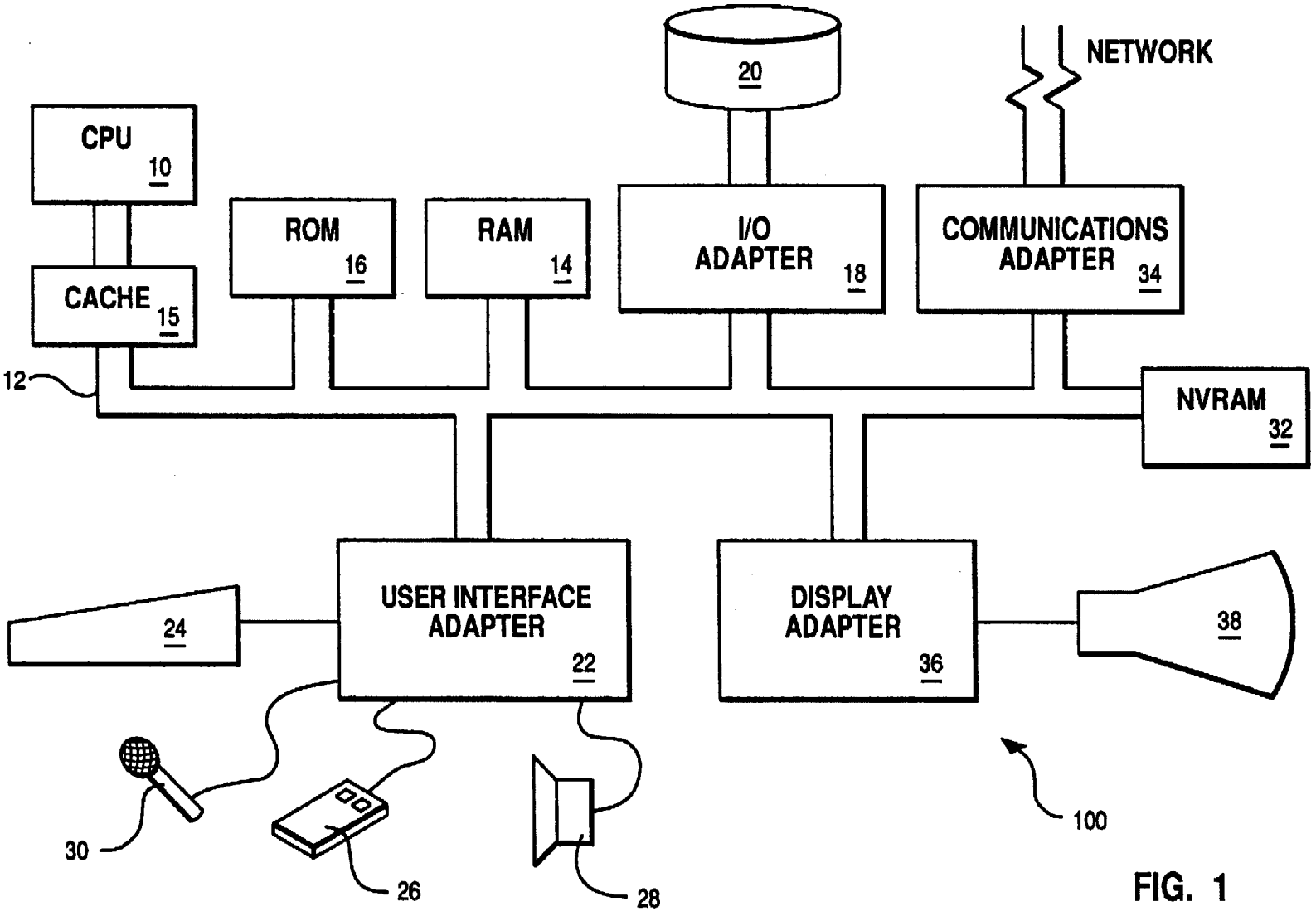
FIG. 1 illustrates A block diagram of a representative hardware environment in accordance with the present invention.

The preferred embodiment is practiced in a laptop computer or, alternatively, in the workstation illustrated in FIG. 1. Workstation 100 includes central processing unit (CPU) 10, such as IBM's™ PowerPC™ 601 or Intel's™ 486 microprocessor for processing cache 15, random access memory (RAM) 14, read only memory 16, and non-volatile RAM (NVRAM) 32. One or more disks 20, controlled by I/O adapter 18, provide long term storage. A variety of other storage media may be employed, including tapes, CD-ROM, and WORM drives. Removable storage media may also be provided to store data or computer process instructions.

Instructions and data from the desktop of any suitable operating system, such as Sun Solaris™, Microsoft Windows NT™, IBM OS/2™, or Apple MAC OS™, control CPU 10 from RAM 14. However, one skilled in the art readily recognizes that other hardware platforms and operating systems may be utilized to implement the present invention.

Users communicate with workstation 100 through I/O devices (i.e., user controls) controlled by user interface adapter 22. Display 38 displays information to the user, while keyboard 24, pointing device 26, microphone 30, and speaker 28 allow the user to direct the computer system. Alternatively, additional types of user controls may be employed, such as a joy stick, touch screen, or virtual reality headset (not shown). Communications adapter 34 controls communications between this computer system and other processing units connected to a network by a network adapter (not shown). Display adapter 36 controls communications between this computer system and display 38.

Figure 2:
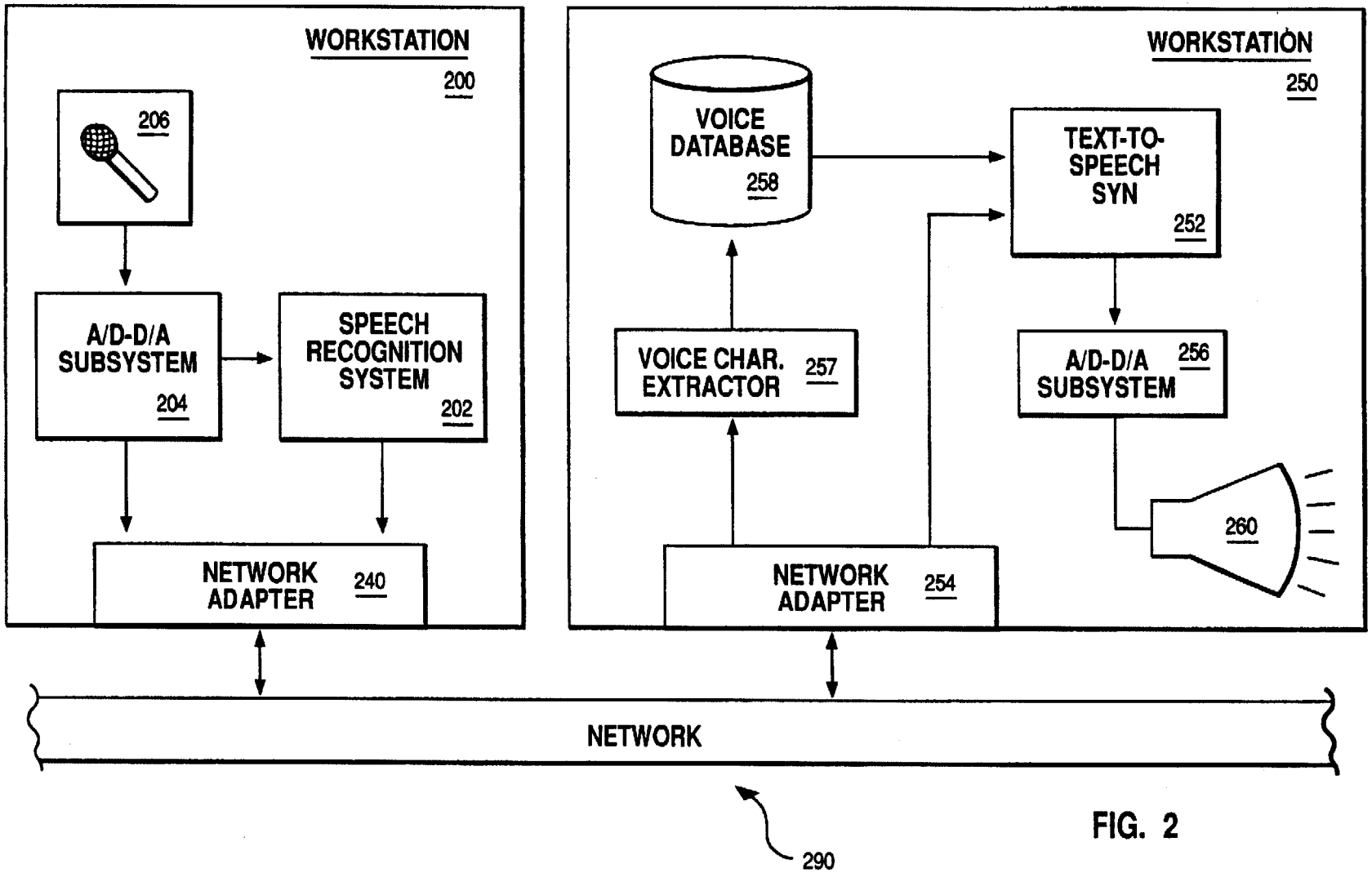
FIG. 2 illustrates a block diagram of an improved voice transmission system in accordance with the present invention.

FIG. 2 illustrates a block diagram of improved voice transmission system 290 in accordance with the present invention. Transmission system 290 includes workstation 200 and workstation 250. Workstations 200 and 250 may include the components of workstation 100 (see FIG. 1). In addition, workstation 200 includes a conventional speech recognition system 202. Speech recognition system 202 includes any suitable dictation product for converting speech into text, such as, for example, the IBM Voicetype Dictation™ product. Therefore, in the preferred embodiment, the user speaks into microphone 206 and A/D subsystem 204 converts that analog speech into digital speech. Speech recognition system 202 converts that digital speech into a text file. Illustratively, 125 seconds of speech produces about 2K byte (i.e., 2 pages) of text. This has a bandwidth requirement of 132 bits/sec (2K/125 sec) compared to the 64000 bits/sac bandwidth and 1 MB of storage space needed to transmit 125 seconds of digitized audio.

Workstation 200 inserts a speaker identification code to the front of the text file and transmits that text file and code via network adapters 240 and 254 to text-to-speech synthesizer 252. The text file may include abbreviations, dates, times, formulas, and punctuation marks. Furthermore, if the user desires to add appropriate intonation and prosodic characteristics to the audio playback of the text, the user adds "tags" to the text file. For example, if the user would like a particular sentence to be annunciated louder and with more emphasis, the user adds a tag (e-g., underline) to that sentence. If the user would like the pitch to increase at the end of a sentence, such as when asking a question, the user dictates a question mark at the end of that sentence. In response, text-to-speech synthesizer 252 interprets those tags and any standard punctuation marks, such as commas and exclamation marks, and appropriately adjusts the intonation and prosodic characteristics of the playback.

Workstations 200 and 250 include any suitable conventional A/D and D/A subsystem 204 or 256, respectively, such as a IBM MACPA (i.e., Multimedia Audio Capture and Playback Adapter), Creative Labs Sound Blaster audio card or single chip solution. Subsystem 204 samples, digitizes and compresses a voice sample of the speaker. In the preferred embodiment, the voice sample includes a small number (e.g., approximately 30) of carefully structured sentences that capture sufficient voice characteristics of the speaker. Voice characteristics include the prosody of the voice—cadence, pitch, inflection, and speed.

Workstation 200 inserts a speaker identification code at the front of the digitized voice sample and transmits that digitized voice sample file via network adapters 240 and 254 to workstation 250. In the preferred embodiment, workstation 200 transmits the voice sample file once per speaker, even though the speaker may subsequently transmit hundreds of text files. In essence, a single set of voice characteristics is transmitted and thereafter multiple text files are transmitted and converted at workstation 250 into audio utilizing the single set of voice characteristics such that a synthesized voice representation of a particular speaker may be transmitted utilizing minimum bandwidth. Alternatively, the voice sample file may be transmitted with the text file. Voice characteristic extractor 257 processes the digitized voice sample file to isolate the audio samples for each diphone segment and to determine characteristic prosody curves. This is achieved using well known digital signal processing techniques, such as hidden Markov models. This data is stored in voice database 258 along with the speaker identification code.

Text-to-speech synthesizer 252 includes any suitable conventional synthesizer, such as the First Byte™ synthesizer. Synthesizer 252 examines the speaker identification code of a text file received from network adapter 254 and searches voice database 258 for that speaker identification code and corresponding voice characteristics. Synthesizer 252 parses each input sentence of the text file to determine sentence structure and selects the characteristic prosody curves from voice database 258 for that type of sentence (e.g., question or exclamation sentence). Synthesizer 252 converts each word into one or more phonemes and then converts each phoneme into diphones. Synthesizer 252 modifies the diphones to account for coarticulation, for example, by merging adjacent identical diphones.

Synthesizer 252 extracts digital audio samples from voice database 258 for each diphone and concatenates them to form the basic digital audio wave for each sentence in the text file. This is done according to the techniques known as Pitch Synchronous Overlap and Add (PSOLA). The PSOLA techniques are well known to those skilled in the speech synthesis art. If the basic audio wave were output at this time, the audio would sound somewhat like the original speaker speaking in a very monotonous manner. Therefore, synthesizer 252 modifies the pitch and tempo of the digital audio waveform according to the characteristic prosody curves found in the voice database 258. For instance, the characteristic prosody curve for a question might indicate a raise in pitch near the end of the sentence. Techniques for pitch and tempo changes are well known to those skilled in the art. Finally, D/A—A/D) subsystem 256 converts the digital audio waveform from synthesizer 252 into an analog waveform, which plays through speaker 260.

While the invention has been shown and described with reference to particular embodiments thereof, it will be understood by those skilled in the art that the foregoing and other changes in form and detail may be made therein without departing from the spirit and scope of the invention, which is defined only by the following claims.

What is claimed is:

1. A computer-implemented method for improved voice transmission, comprising the steps of:

converting an audio voice sample of a particular user into a single set of voice characteristics, at a first system;

transmitting the single set of voice characteristics to a second system;

storing said single set of voice characteristics in a voice data base in the second system;

subsequently, converting a plurality of voice inputs from the particular user into a plurality of text files at the first system;

transmitting each of the plurality of text files to the second system; and thereafter, converting each of the plurality of text files into audio utilizing the single set of voice characteristics wherein a synthesized voice representative of the particular user is transmitted utilizing minimum bandwidth.

2. The computer implemented method according to claim 1, further including the step of inserting tags into each of the plurality of text files to indicate prosody.

3. The computer implemented method according to claim 2, wherein the step of converting each of the plurality of text files into audio utilizing the single set of voice characteristics further comprises the step of converting each of the plurality of text files into audio utilizing the single set of voice characteristics and the inserted tags.

4. The computer implemented method according to claim 1, wherein the step of converting an audio voice sample of a particular user into a single set of voice characteristics further comprises the steps of:

capturing samples of the voice of the particular user;

sampling and digitizing the captured voice samples, thereby forming digitized voice; and extracting a single set of voice characteristics from the digitized voice.

5. The computer implemented method according to claim 1, further including the step of inserting a voice identification code identifying said particular user into the single set of voice characteristics.

6. The computer implemented method according to claim 5, further including the step of appending the voice identification code to each of the plurality of text files before transmitting.

7. The computer implemented method according to claim 6, wherein the step of converting each of the plurality of text files into audio utilizing the single set of voice characteristics further the comprises the steps of:

extracting the single set of voice characteristics for the particular user from the voice data base based upon the voice identification code transmitted with each of the plurality of text files;

mapping each of the plurality of text files into digital audio samples using the single set of voice characteristics; and playing the digital audio samples utilizing a digital-to-analog subsystem to produce audio.

8. A computer system for transmitting voice, said computer system comprising:

means for converting an audio voice sample of a particular user into a single set of voice characteristics, at a first system;

means for transmitting the single set of voice characteristics to a second system;

means for storing said single set of voice characteristics in a voice data base in the second system;

means for subsequently, converting a plurality of voice inputs from the particular user into a plurality of text files at the first system;

means for transmitting each of the plurality of text files to the second system; and means for thereafter converting each of the plurality of text files into audio utilizing the single set of voice characteristics wherein a synthesized voice representative of the particular user is transmitted utilizing minimum bandwidth.

* * * * *